US008890908B2

(12) United States Patent
Wu et al.

(10) Patent No.: US 8,890,908 B2
(45) Date of Patent: Nov. 18, 2014

(54) METHOD AND APPARATUS FOR DISPLAY CALIBRATION

(75) Inventors: Jiaying Wu, Santa Clara, CA (US); Gabriel Marcu, San Jose, CA (US); Wei Chen, Palo Alto, CA (US); Hopil Bae, Sunnyvale, CA (US); Cheng Chen, San Jose, CA (US); Ye Yin, Santa Clara, CA (US); Anuj Bhatnagar, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 184 days.

(21) Appl. No.: 13/477,680

(22) Filed: May 22, 2012

(65) Prior Publication Data

US 2013/0314447 A1 Nov. 28, 2013

(51) Int. Cl.
*G09G 5/10* (2006.01)

(52) U.S. Cl.
USPC ..... 345/690; 345/204; 345/12; 345/20; 345/63; 345/77; 345/89; 345/581; 345/618; 340/815.55; 358/1.9; 358/3.32

(58) Field of Classification Search
USPC ..... 345/690, 594, 600, 153, 150, 154, 603, 345/589; 348/167, 602, 603, 179, 655; 382/167, 274; 358/504, 518
See application file for complete search history.

(56) References Cited

U.S. PATENT DOCUMENTS

| | | | | |
|---|---|---|---|---|
| 6,480,202 | B1 * | 11/2002 | Deguchi et al. | 345/600 |
| 7,190,372 | B2 * | 3/2007 | Choi et al. | 345/589 |
| 7,328,116 | B2 * | 2/2008 | Bala et al. | 702/107 |
| 7,502,038 | B2 | 3/2009 | Yasuda et al. | |
| 7,777,755 | B2 | 8/2010 | Marcu et al. | |
| 7,876,356 | B2 | 1/2011 | Xu et al. | |
| 7,884,838 | B2 | 2/2011 | Lee et al. | |
| 8,179,405 | B2 | 5/2012 | Evanicky et al. | |
| 2003/0091230 | A1 * | 5/2003 | Choi et al. | 382/162 |
| 2006/0007249 | A1 * | 1/2006 | Reddy et al. | 345/690 |
| 2007/0133061 | A1 * | 6/2007 | Bang et al. | 358/3.26 |
| 2008/0259092 | A1 * | 10/2008 | Hayward | 345/604 |
| 2010/0103327 | A1 * | 4/2010 | Lentz | 348/714 |
| 2010/0315429 | A1 | 12/2010 | Rykowski | |

FOREIGN PATENT DOCUMENTS

| | | |
|---|---|---|
| KR | 10-2000-069835 | 11/2000 |
| KR | 10-2003-029659 | 4/2003 |

OTHER PUBLICATIONS

Marcu et al., U.S. Appl. No. 13/407,552, filed Feb. 28, 2012.
Albrecht et al., U.S. Appl. No. 13/569,940, filed Aug. 8, 2012.

* cited by examiner

*Primary Examiner* — Olga Merkoulova
(74) *Attorney, Agent, or Firm* — Treyz Law Group; Kendall P. Woodruff

(57) ABSTRACT

A calibration system may be provided for calibrating displays in electronic devices during manufacturing. The calibration system may include calibration computing equipment and a test chamber having a light sensor. The calibration computing equipment may be configured to operate the light sensor and the display to gather display intensity performance data for obtaining a display gamma model. The display intensity performance data may be gathered using a range of display control settings that will be used in performing color calibration operations for the display. The calibration computing equipment may be configured to operate the light sensor and the display to gather display color performance data for determining a display white point calibration. Display white point calibration data may be provided to the electronic device and stored in volatile or non-volatile memory in the device or may be permanently stored in circuitry associated with the display.

21 Claims, 11 Drawing Sheets

METHOD AND APPARATUS FOR DISPLAY CALIBRATION

BACKGROUND

This relates to calibration, and, more particularly, to calibration of displays in electronic devices.

Electronic devices such as portable computers, media players, cellular telephones, set-top boxes, and other electronic equipment are often provided with displays for displaying visual information.

Display color performance for a given display can be characterized by a native white point. The native white point of a display is commonly defined by a set of chromaticity values. The chromaticity values associated with the native white point are used to represent the color produced by the display when all colors of display pixels in the display are operating at full power.

Due to manufacturing variations, the native white point of one display may be different from the native white point of another display. Display color performance variations of this type can pose challenges when attempting to manufacture electronic devices having consistent display color performance. Device displays are therefore sometimes calibrated during manufacturing by adjusting the white point of the display.

The white point of a display is typically adjusted using a previously measured display gamma model that describes the relationship between digital display control values and display light intensities resulting from applying those digital display control values. The display gamma model is commonly determined in a separate calibration operation.

Performing separate gamma model determination operations and color performance calibration operations can cause undesirable delays in the production of electronic devices with displays.

It would therefore be desirable to be able to provide improved calibration systems for calibrating electronic devices with color displays.

SUMMARY

A calibration system may be provided for calibrating a display in an electronic device during manufacturing.

A display may include a liquid crystal display with display pixels for generating light of various colors. The display may be provided with display driver circuitry for operating the display pixels. The display driver circuitry may drive selected combinations of colored display pixels at respective selected power levels to generate light having a desired color.

During display calibration operations, display calibration operations may be performed by identifying optimal parameters of a display gamma model and performing iterative white point calibration adjustments for the display using the display gamma model. The display gamma model may be used to describe the change in display light intensity that results from a change in digital control setting provided to the display.

Identifying the optimal parameters of the display gamma model may include gathering display intensity performance data (sometimes referred to herein as gamma performance data) while operating the display using display control settings in a desired range of display control settings. The desired range may be a range of digital display control values that are also to be used in performing display color performance calibration operations. For example, the desired range may include digital display control values corresponding to display pixel power levels at or near a maximum power level for the display. The desired range may be determined using previously gathered display performance data.

Performing iterative white point adjustments for the display may include gathering display color performance data in the desired range, converting the display color performance data into a set of tristimulus values, comparing the tristimulus values to target tristimulus values, generating display calibration parameters based on the comparison of the tristimulus values to target tristimulus values, and providing the display calibration parameters to the electronic device.

Display calibration parameters received by the device may be stored in a boot sector of device memory to be accessed during boot operations or may be coded into display circuitry associated with the display and used to operate the display in a calibrated mode during boot operations.

If desired, initial display calibration parameters based on the previously observed display performance of displays in additional devices may be provided to the device at the start of display calibration operations.

Further features of the invention, its nature and various advantages will be more apparent from the accompanying drawings and the following detailed description of the preferred embodiments.

DETAILED DESCRIPTION

Electronic devices such as cellular telephones, media players, computers, set-top boxes, wireless access points, and other electronic equipment having displays may be calibrated during manufacturing. Displays may include liquid-crystal display (LCD) screens, light-emitting diodes (LEDs), organic light-emitting diodes (OLEDs), and other components such as touch-sensitive components that present visual information and status data and/or gather user input data. Display color performance may be characterized, in part, by color performance statistics such as a display white point. The display white point of a given display may be measured and modified to be close to a target white point during calibration operations. A display gamma parameter may be measured during display white point calibration operations using display white point information such as display white point performance data of displays in one or more additional devices.

Figure 1:
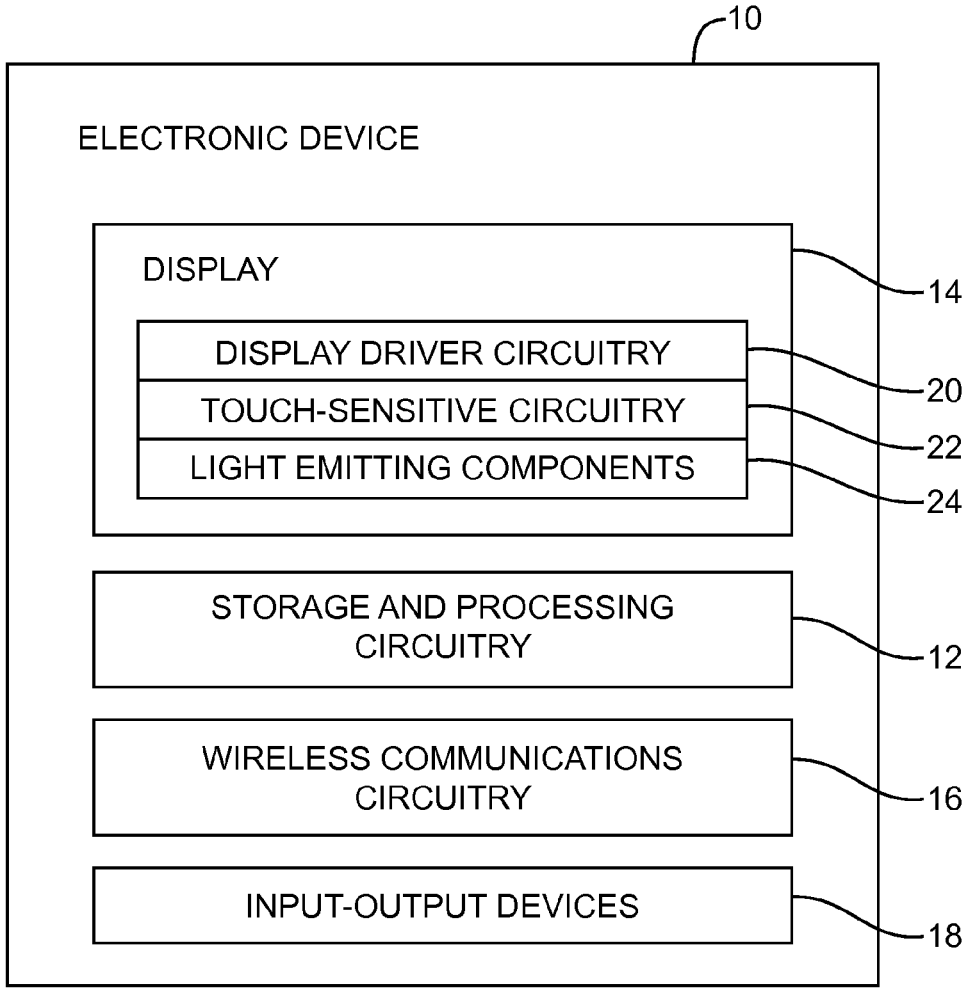
FIG. 1 is a diagram of an illustrative electronic device having a display in accordance with an embodiment of the present invention.

An illustrative electronic device of the type that may be provided with a display is shown in FIG. 1. Electronic device 10 may be a computer such as a computer that is integrated into a display such as a computer monitor, a laptop computer, a tablet computer, a somewhat smaller portable device such as a wrist-watch device, pendant device, or other wearable or miniature device, a cellular telephone, a media player, a tablet computer, a gaming device, a navigation device, a computer monitor, a television, or other electronic equipment.

As shown in FIG. 1, device 10 may include a display such as display 14. Display 14 may include light-emitting components 24, touch-sensitive circuitry 22, display driver circuitry 20 for operating light-emitting components 24, and other display components.

Light-emitting components 24 may include display pixels formed from reflective components, liquid crystal display (LCD) components, organic light-emitting diode (OLED) components, or other suitable display pixel structures. To provide display 14 with the ability to display color images, light-emitting components 24 may include display pixels having color filter elements. Each color filter element may be used to impart color to the light associated with a respective display pixel in the pixel array of display 14.

Display touch-circuitry such as touch-sensitive circuitry 22 may include capacitive touch electrodes (e.g., indium tin oxide electrodes or other suitable transparent electrodes) or other touch sensor components (e.g., resistive touch technologies, acoustic touch technologies, touch sensor arrangements using light sensors, force sensors, etc.). Display 14 may be a touch screen that incorporates display touch circuitry 22 or may be a display that is not touch sensitive.

Display driver circuitry 20 may, as an example, include a driver integrated circuit that is mounted to a display layer such as a thin-film-transistor layer of a liquid crystal display. Display driver circuitry 20 may be coupled to additional circuitry in device 10 such as storage and processing circuitry 12.

Control circuitry such as storage and processing circuitry 12 in device 10 may include microprocessors, microcontrollers, digital signal processor integrated circuits, application-specific integrated circuits, and other processing circuitry. Volatile and non-volatile memory circuits such as random-access memory, read-only memory, hard disk drive storage, solid state drives, and other storage circuitry may also be included in processing circuitry 12. Circuitry 12 may include storage configured to store boot information to be used during boot operations for the device. Display calibration information may be stored as part of the boot information or may be stored using display driver circuitry 20 or other circuitry associated with display 14.

Circuitry 12 may use wireless communications circuitry 16 and/or input-output devices 18 to obtain user input and to provide output to a user. Input-output devices 18 may include speakers, microphones, sensors, buttons, keyboards, displays, touch sensors, and other components for receiving input and supplying output. Wireless communications circuitry may include wireless local area network transceiver circuitry, cellular telephone network transceiver circuitry, and other components for wireless communication.

Figure 2:
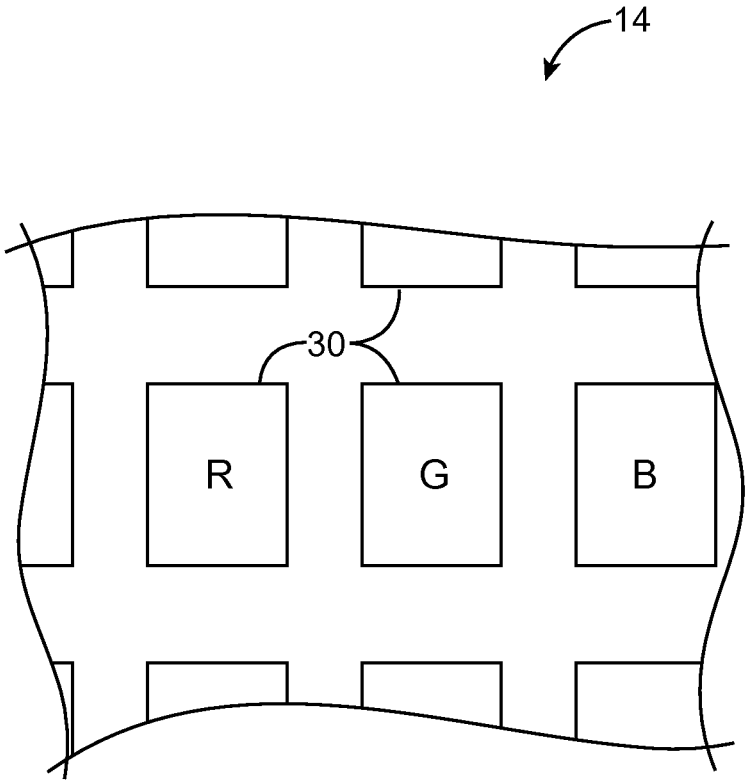
FIG. 2 is a diagram of an illustrative portion of a display showing how colored display pixels may be arranged in rows and columns in accordance with an embodiment of the present invention.

Display 14 may include an array of display pixels. Each display pixel may be used to generate display light associated with a portion of the display. A portion of an illustrative array of display pixels is shown in FIG. 2. As shown in FIG. 2, display 14 may have a pixel array with rows and columns of pixels 30. There may be tens, hundreds, or thousands of rows and columns of display pixels 30. Each pixel 30 may, if desired, be a color pixel such as a red (R) pixel, a green (G) pixel, a blue (B) pixel or a pixel of another color. Red pixels R, for example, may include a red color filter element over a light generating element (e.g., an LED or a liquid crystal element) that absorbs and/or reflects non-red light while passing red light. However, this is merely illustrative. Pixels 30 may include any suitable structures for generating light of a given color.

Display driver circuitry 20 (FIG. 1) such as a display driver integrated circuit and, if desired, associated thin-film transistor circuitry formed on a display substrate layer may be used to produce signals such as data signals and gate line signals (e.g., on data lines and gate lines respectively in display 14) for operating pixels 30 (e.g., turning pixels 30 on and/or off and/or adjusting the intensity of pixels 30). During operation, display driver circuitry 20 may control the values of the data signals and gate signals to control the light intensity associated with each of the display pixels and thereby display images on display 14.

Display driver circuitry 20 may be used to convert digital display control values for each display pixel 30 into analog display signals for controlling the brightness of each pixel. Control circuitry such as storage and processing circuitry 12 may provide digital display control values (commonly integers with values between 0-255) corresponding to the desired pixel intensity of each pixel to display driver circuitry 20. For example, a digital display control value of 0 may result in an "off" pixel while a digital display control value of 255 may result in a pixel operating at a maximum available power.

Display driver circuitry 20 may be used to concurrently operate pixels 30 of different colors in order to generate light having a color that is a mixture of, for example, primary colors red, green, and blue. As examples, operating red pixels R and blue pixels B may produce light that appears violet, operating red pixels R and green pixels G may generate light that appears yellow, and operating red pixels R, green pixels G and blue pixels B may generate light that appears white.

However, light that appears white to a human eye may include various different underlying spectral power distributions (e.g., may be generated from various combinations of light of individual colors such as red, green, and blue). As examples, sunlight appears white to the human eye, but includes a relatively large amount of blue light, whereas light from an incandescent light bulb appears white to the human eye but includes a relatively large amount of red light.

Due to manufacturing variances, at full power, some displays may generate relatively larger or smaller amounts of light of each color in comparison with other displays. Due to these manufacturing differences, the white light produced by a display in one device may differ from the white light produced by a display in another device.

These differences may be corrected by adjusting the display control settings of the display in one device so that the display color performance of that display matches the display color performance of a display in another device. Adjusting the display control settings of a display may, for example, include adjusting the relative maximum power levels that display control circuitry such as circuitry 20 (FIG. 1) delivers to pixels 30 of each color. Maximum power levels for pixels 30 of each color may be reduced, for example, by reducing the maximum possible digital display control value for the pixels of that color (e.g., from a maximum value of 255 to a maximum value of 251).

In order to produce electronic devices with displays that exhibit uniform display performance across all devices, the display in each device may be calibrated during manufacturing so that the display color performance (e.g., the spectral content of white light) of the display in each device matches a standard (sometimes called a target) display color performance. Calibrating a display may include determining one or more parameters of a display gamma model (e.g., a model that describes the effect on pixel intensity of a particular change in a digital display control value) and providing display calibration data based on gathered display performance data and the display gamma model to the device.

Figure 3:
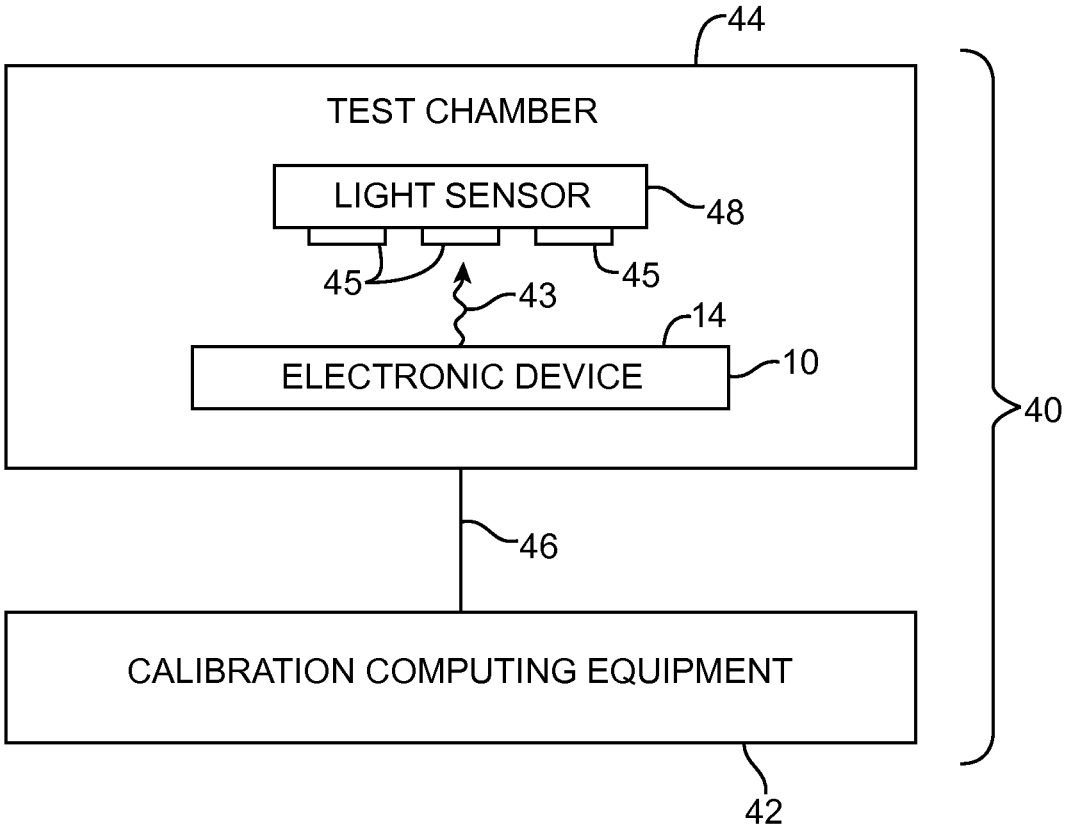
FIG. 3 is a diagram of an illustrative calibration system for performing display calibration including calibration computing equipment and a test chamber having a light sensor in accordance with an embodiment of the present invention.

FIG. 3 is a diagram of an illustrative calibration system that may be used in calibrating displays for devices such as device 10. As shown in FIG. 3, calibration system 40 may include calibration computing equipment 42 that is coupled to a test apparatus such as test chamber 44. Calibration computing equipment 42 may include one or more computers, one or more databases, one or more displays, one or more technician interface devices (e.g., keyboards, touch-screens, joysticks, buttons, switches, etc.) for technician control of calibration computing equipment 42, communications components or other suitable calibration computing equipment.

Calibration computing equipment may be coupled to test chamber 44 using a wired or wireless communications path such as path 46.

Test chamber 44 may include a light sensor such as light sensor 48. Light sensor 48 may include one or more light-sensitive components 45 for gathering display light 43 emitted by display 14 during calibration operations. Light sensor 48 may include light-sensitive components 45 configured to gather colored light such as colorimetric light-sensitive components and spectrophotometric light-sensitive components.

Light sensor 48 may, for example, be a colorimeter having one or more light-sensitive components 45 corresponding to each set of colored pixels in display 14. For example, a display having red, green and blue display pixels may be calibrated using a light sensor having corresponding red, green, and blue light-sensitive components 45. However, this is merely illustrative. A display may include display pixels for emitting colors other than red, green, and blue, and light sensor 48 may include light-sensitive components 45 sensitive to colors other than red, green, and blue, may include white light sensors, or may include spectroscopic sensors.

Light sensor 48 may be used by system 40 to convert display light 43 into display performance data for calibrating the performance of displays such as display 14. For example, calibration computing equipment 42 may be used to operate light sensor 48 for gathering display intensity performance data (e.g., data corresponding to display light intensities as a function of digital display control values) and display color performance data (e.g., native white point performance data, corrected white point performance data, etc.) for calibrating displays such as display 14.

Test chamber 44 may, if desired, be a light-tight chamber that prevents outside light (e.g., ambient light in a testing facility) from reaching light sensor 48 during calibration operations.

During calibration operations, device 10 may be placed into test chamber 44 (e.g., by a technician or by a robotic member). Calibration computing equipment 42 may be used to operate device 10 and light sensor 48 during calibration operations. For example, calibration computing equipment 42 may issue a command (e.g., by transmitting a signal over path 46) to device 10 to operate some or all pixels of display 14. While device 10 is operating the pixels of display 14, calibration computing equipment 42 may operate light sensor 48 to gather display intensity performance data (display gamma performance data) and/or display color performance data corresponding to the light 43 emitted by display 14.

Calibration computing equipment 42 may use display color performance information such as a desired range of digital display control values in gathering display intensity performance data. The desired range may be a range of digital display control values that is also to be used for gathering display color performance data for display white point calibration. Calibration computing equipment 42 may be used to identify one or more parameters (e.g., a gamma value) of a gamma model describing how display intensity produced by display 14 is related to each digital display control value from the display intensity performance data in the desired range. In this way, display gamma calibration (display intensity performance calibration) and display color performance calibration can be performed using a minimal amount of data, thereby reducing the time required for calibration of each display.

Calibration computing equipment 42 may receive display intensity performance data and/or display color performance data from light sensor 48 over path 46. Calibration computing equipment 42 may be used to process the gathered data to optimize a display gamma model using the display intensity performance data (gamma performance data) and to generate display calibration data such as display calibration parameters using the optimized gamma model and the gathered display color performance data. Display calibration data for each display may be used to appropriately alter display settings for that display so that the corrected white point of the display is within a predetermined range of a target white point.

Display calibration data may be provided to device 10 from calibration computing equipment 42 during calibration operations. Display calibration data received by device 10 may be stored on device 10 using storage and processing circuitry 12 (FIG. 1). Display calibration data may be stored in volatile or non-volatile memory associated with storage and processing circuitry 12 for access by software running on circuitry 12 and/or display calibration data may be hard coded into firmware associated with display (e.g., display driver circuitry 20).

In configurations in which display calibration data is stored in volatile or non-volatile memory associated with storage and processing circuitry 12, the display calibration data may be accessed during startup operations (sometimes referred to herein as boot operations) for device 10. In this type of configuration, display 14 may be operated in an uncalibrated mode during a first portion of the startup operations and may be operated in a calibrated mode during a second portion of the startup operations. The second portion of the startup operations may follow accessing of the display calibration data during the first portion of the startup operations.

In configurations in which display calibration data is stored using circuitry associated with display 14 (e.g., display driver circuitry 20), display 14 may be operated in a color calibrated mode that uses the display calibration data during substantially all of the startup operations (boot operations) for the device.

For example, operating the display in the color calibrated mode may include providing display control signals from storage and processing circuitry 12 (FIG. 1) to the display, adjusting the provided display control signals using display white point calibration data that is stored in the display control circuitry, and operating display pixels in the display using the adjusted display control signals. In this way, a device such as device 10 may be provided with a color calibrated display that displays color calibrated images even during boot operations.

Calibration system 40 may be configured to calibrate display color performance for tens, hundreds, thousands, tens of thousands, hundreds of thousands, millions, tens of millions, or more than tens of millions of devices such as device 10. Providing calibration systems 40 that are capable of performing display calibration operations using minimal amounts of display performance data (e.g., by determining a display gamma model using display intensity performance data gathered using a range of digital display control values that are to be used for performing display white point calibrations) may therefore significantly reduce the time required to move devices from manufacturing to delivery to end users.

Figure 4:
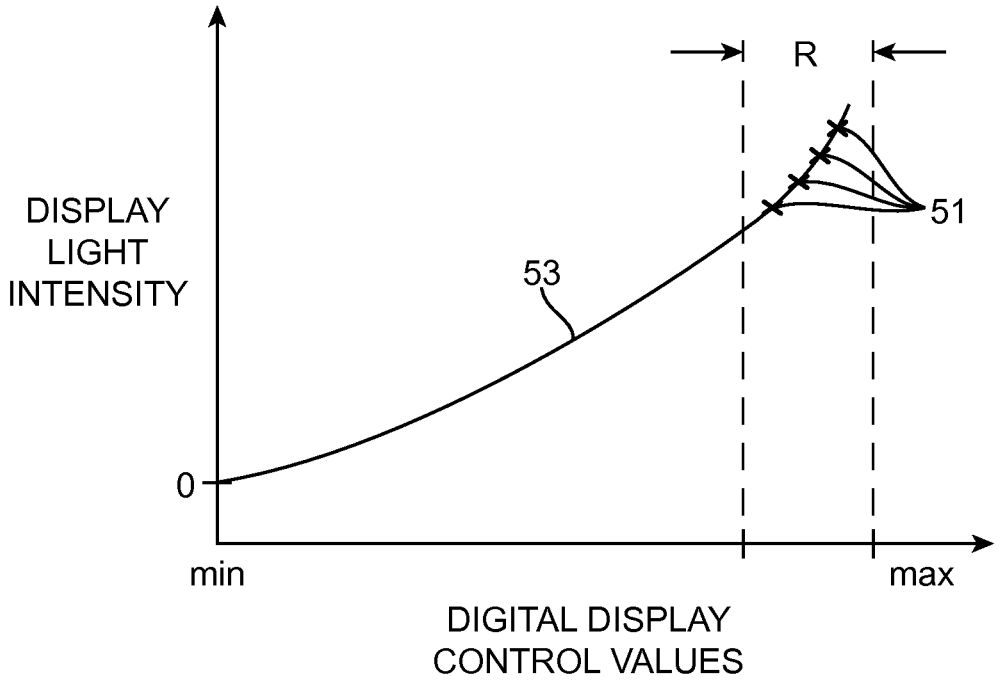
FIG. 4 is an illustrative graph showing how display intensity performance data gathered using set of digital display control values in a range of digital display control values to be used in performing display color performance calibration operations may be used to obtain a gamma model for the display in accordance with an embodiment of the present invention.

FIG. 4 is an illustrative graph showing how display intensity performance data within a range of digital display control values that are to be used for performing display white point calibration operations can be used in optimizing a gamma model for the display. A display gamma model such as gamma model 53 may be used to describe the intensity of light generated by a display as a function of digital display control values provided to the display for the entire range of available digital control values.

As shown in FIG. 4, gamma model 53 can be determined using display intensity performance data such as gamma performance data 51 in a sub-range such as range R of the total range of available digital display control values. Range R may be a range of digital display control values that are useful in performing display color performance calibration operations.

For example, during display color performance calibration operations, a display such as display 14 may be operated to generate display light by providing digital display control values in range R to the display. Display color performance data may be gathered while operating the display using the digital display control values in range R. The total range of available digital display control values may, for example, extend from a minimum digital display control value MIN equal to zero to a maximum digital display control value MAX equal to 255.

During display gamma calibration operations, data 51 may be gathered by measuring display intensities while operating the display using, for example, four digital display control values in range R. Gamma model 53 may be determined using data 51 by fitting parameters (e.g., a gamma value, a gain value, or other parameters) of a suitable model to data 51 using a linear regression process or any other suitable data fitting process. Suitable models may include, as examples, a single power law function, a gain-offset-gamma (GOG) model, a gain-offset-gamma-offset (GOGO) model or a gain-gamma-offset (GGO) model. However, the example of FIG. 4 in which four gamma performance data points 51 are gathered is merely illustrative. If desired, one, two, three, or more than four data points in range R may be gathered and used to obtain gamma model 53.

Figure 5:
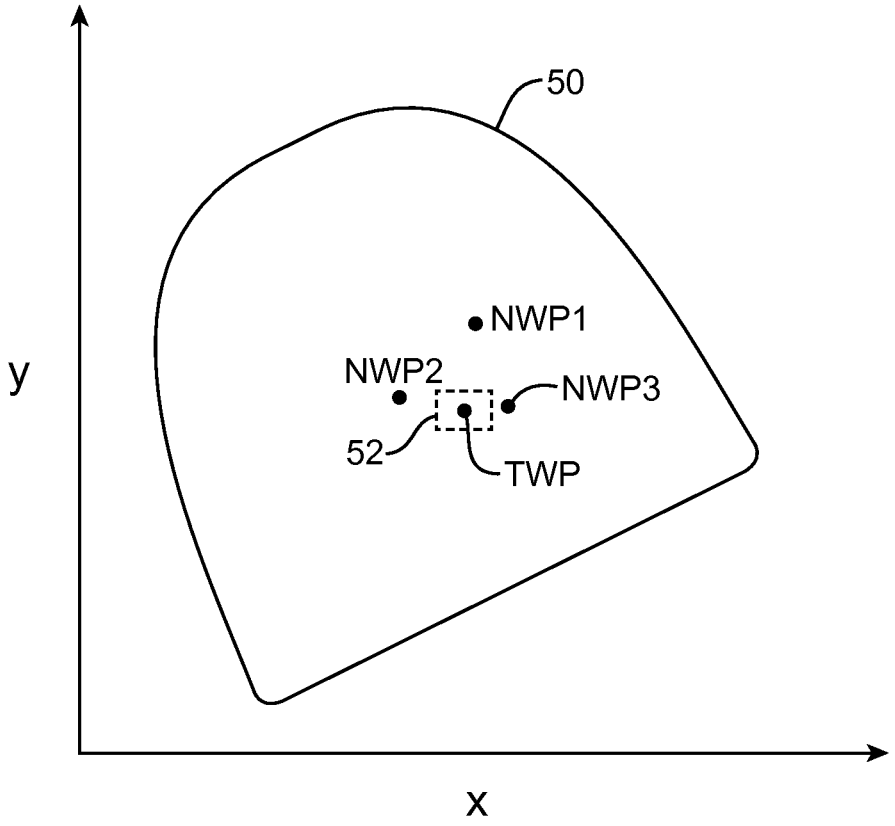
FIG. 5 is an illustrative chromaticity diagram showing how native display white points of various displays may be distributed with respect to a target white point in accordance with an embodiment of the present invention.

FIG. 5 is a chromaticity diagram showing a two-dimensional projection of a color space. The color generated by a display such as display 14 may be represented by the chromaticity values x and y. The chromaticity values may be computed by transforming, for example, three color intensities (e.g., intensities of colored light emitted by a display) such as red intensity, blue intensity, and green intensity into three tristimulus values X, Y, and Z and normalizing the first two tristimulus values X and Y (e.g., by computing $x=X/(X+Y+Z)$ and $y=Y/(X+Y+Z)$). Transforming the color intensities into tristimulus values may be performed using transformations defined by the International Commission on Illumination (CIE) or any other suitable color transformation for computing tristimulus values.

Any color generated by a display such as display 14 may therefore be represented by a point (e.g., a pair of chromaticity values x and y) on a chromaticity diagram such as the diagram shown in FIG. 5. Bounded region 50 of FIG. 5, represents the chromaticity values of all combinations of colors (i.e., the total available color space). The colors that may be generated by a given display are contained within a sub-region of bounded region 50.

Display color performance of a display such as display 14 may be characterized by color performance statistics such as the "white point" of the display. The white point of a given display is commonly defined by a set of chromaticity values that represent the color produced by the given display when the display is generating all available display colors at full power. Prior to any corrections during calibration, the white point of the display may be referred to as the "native white point" (NWP) of that display.

Due to manufacturing differences between displays, the color performance of a display may differ, prior to calibration of the display, from the desired (target) color performance of the display. The desired display color performance may be characterized by a "target white point" TWP (e.g., a set of chromaticity values that represent the color produced by a standard display or illuminant). For example, a target white point TWP may be the white point corresponding to the D65 illuminant of the International Commission on Illumination (CIE). However, this is merely illustrative. Any suitable target white point TWP may be used for calibration of displays such as display 14.

The difference between the native (i.e., uncalibrated) color performance of various displays and the target color performance for those displays may be characterized by a difference between the native white point of those displays (e.g., native white points NWP1, NWP2, and NWP3 of three illustrative displays) and the target white point TWP as shown in FIG. 5.

During calibration operations, by adjusting the relative output of one or more colors of pixels 30 of display 14, the white point of a display may be adjusted (corrected) to within a predetermined range such as range 52 of a target display color performance such as a target white point (TWP). Display calibration data may be provided to device 10 that corresponds to adjustments to display control settings that result in a correction of the display white point to within the predetermined range of the target white point. However, this is merely illustrative. In some scenarios, the measured native white point NWP of the display may be within specified range 52 and calibration operations may be terminated after determination of the display gamma model without making any color performance calibration corrections to the display.

As shown in FIG. 5, the native white point NWP of one or more displays such as display 14 (e.g., NWP1, NWP2, NWP3, etc.) may be distributed in various locations in the chromaticity diagram with respect to a desired, target white point for all displays. By measuring the distribution of native white points of various displays with respect to the target white point, an average display color calibration value may be determined based on the difference between the average native white point of multiple previously calibrated displays and the target white point. Initial display calibration data may be generated that corresponds to the difference between the average native white point and the target white point.

If desired, during calibration operations, this initial display calibration data may be applied to the display control settings of each display in order to make an initial color correction prior to measurement of the native white point of the display. Providing each display with an initial color calibration correction in this way may help reduce the number of iterative corrections to be performed in calibrating the color performance of the display, thereby reducing the overall duration of display calibration operations.

Adjusting the white point of a display to within a range such as range 52 by adjusting the relative output of one or more colors of pixels 30 of display 14 may include adjusting the maximum power levels that display control circuitry such as circuitry 20 (FIG. 1) delivers to pixels 30 of each color. Maximum power levels for pixels 30 of each color may be reduced by reducing the maximum possible digital display control value for the pixels of that color (e.g., from a maximum value of 255 to a maximum value of 251). Display calibration data may be generated that represents, for example, this type of change in digital display control values.

However, in order for a calibration system to determine the change in maximum digital display control values that will result in the desired change in pixel intensity, the calibration system may first determine an optimized display gamma model for describing the effect on pixel intensity of a particular change in a digital display control value.

Calibration system 40 may determine parameters (e.g., a gamma value) of the display gamma model by gathering display intensity performance data while operating the display pixels using digital display control values that are in a range of digital display control values to be used to measure the native white point NWP of that display.

The calibration system may fit parameters of a given display gamma model (e.g., a single power law function, a gain-offset-gamma (GOG) model, a gain-offset-gamma-offset (GOGO) model or a gain-gamma-offset (GGO) model) to the gathered display intensity performance data in that range. Determining the gamma model using digital display control values that are in a range of digital display control values to be used to measure the native white point NWP in this way may help reduce the overall amount of data gathered during calibration operations. Reducing the overall amount of data gathered during calibration operations in this way may help shorten the time of calibration operations for each device display.

The display gamma model and the gamma value determined using the digital display control values that will be used to measure the native white point NWP may be used in generating display calibration data for correcting the native white point NWP of that display to within the acceptable range of the target white point TWP.

Figure 6:
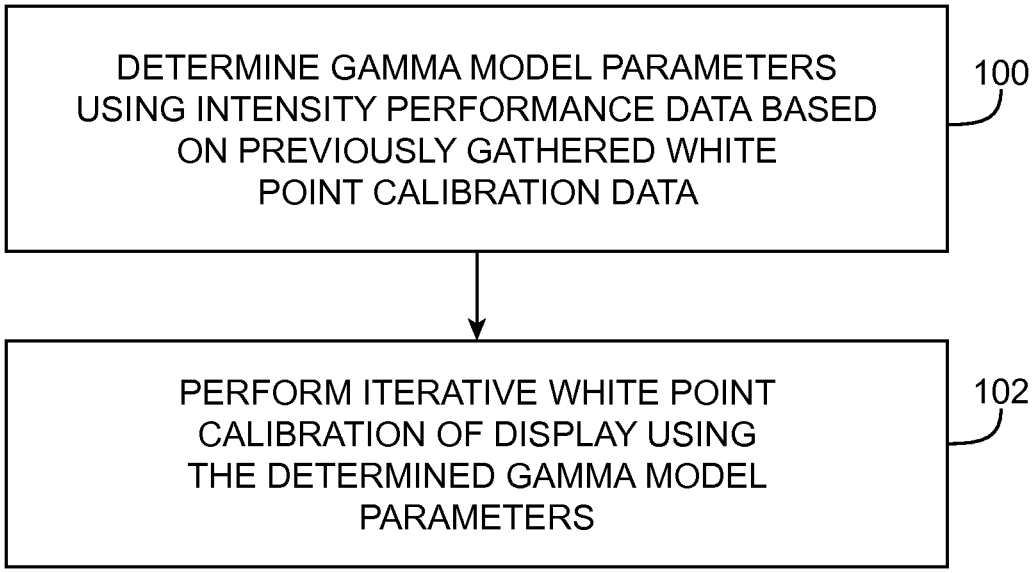
FIG. 6 is a flow chart of illustrative steps involved in performing display gamma and display white point calibration for electronic devices having displays in accordance with an embodiment of the present invention.

A flow chart of illustrative steps involved in performing calibration of displays in electronic devices is shown in FIG. 6.

At step 100, one or more parameters of a gamma model for the display may be determined using gamma performance data (display intensity performance data) that is based, at least in part, on previously gathered white point calibration data (e.g., a range of display control settings based on white point calibration data for other, previously calibrated displays).

At step 102, an iterative white point calibration of the display may be performed using the gamma model parameters determined at step 100.

Figure 7:
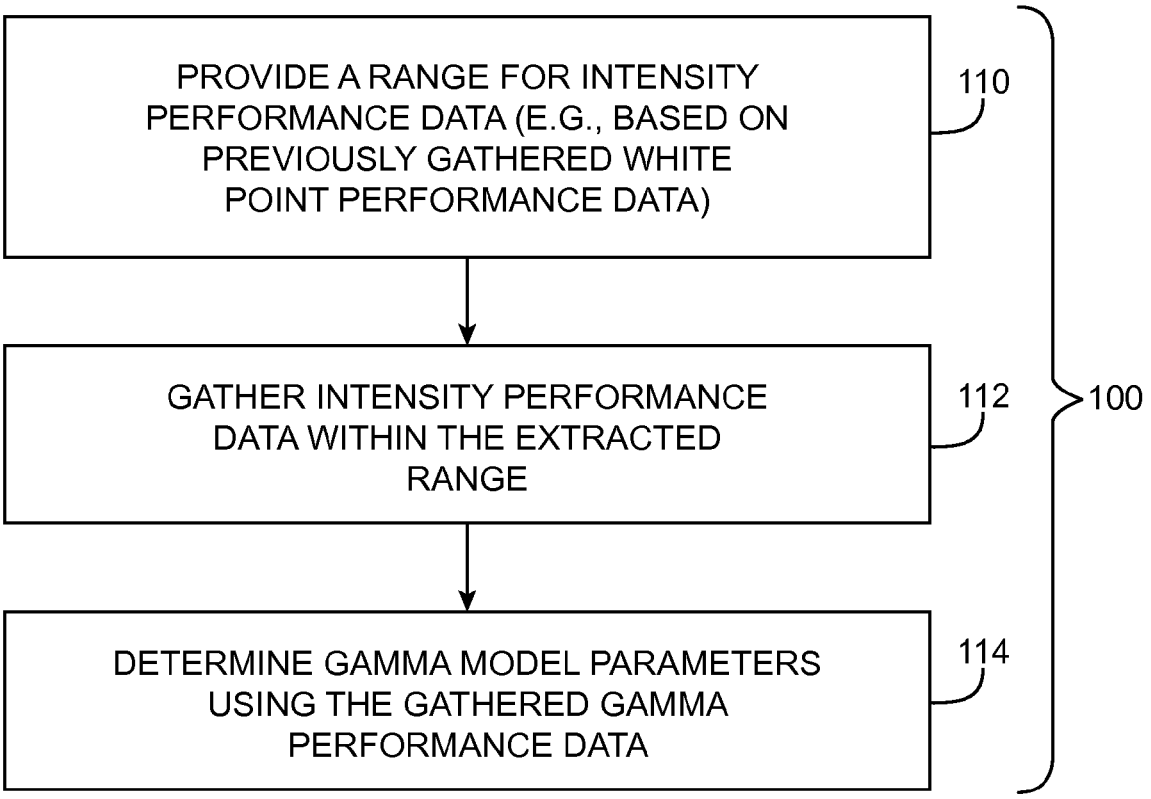
FIG. 7 is a flow chart of illustrative steps involved in obtaining a display gamma model using a range of display control settings to be used in gathering display color performance data in accordance with an embodiment of the present invention.

A flow chart of illustrative steps involved in determining the display gamma model parameters as described above in connection with step 100 of FIG. 6 are shown in FIG. 7.

At step 110, a range such as a range of digital display control values to be used in gathering display white point data may be provided. The range of digital display control values may, for example, be extracted from previously gathered display white point data (e.g., white point calibration data for other, previously calibrated displays). The range of digital display control values may, as examples, be between 200 and 255, between 220 and 255, between 235 and 255, between 200 and 250, or greater than 200. A range may be provided for each color of display pixels in the display. The range for each color of display pixels in the display may be common for all colors or may be different for each color.

At step 112, display intensity performance data may be gathered. The intensity performance data may include pixel intensity data gathered while operating the display pixels using digital display control values within the provided range.

At step 114, the display gamma model parameters may be determined using the gathered display intensity performance data (e.g., by fitting the value of gamma in a gamma model such as a single power law function, a gain-offset-gamma (GOG) model, a gain-offset-gamma-offset (GOGO) model or a gain-gamma-offset (GGO) model to the display intensity performance data).

Figure 8:
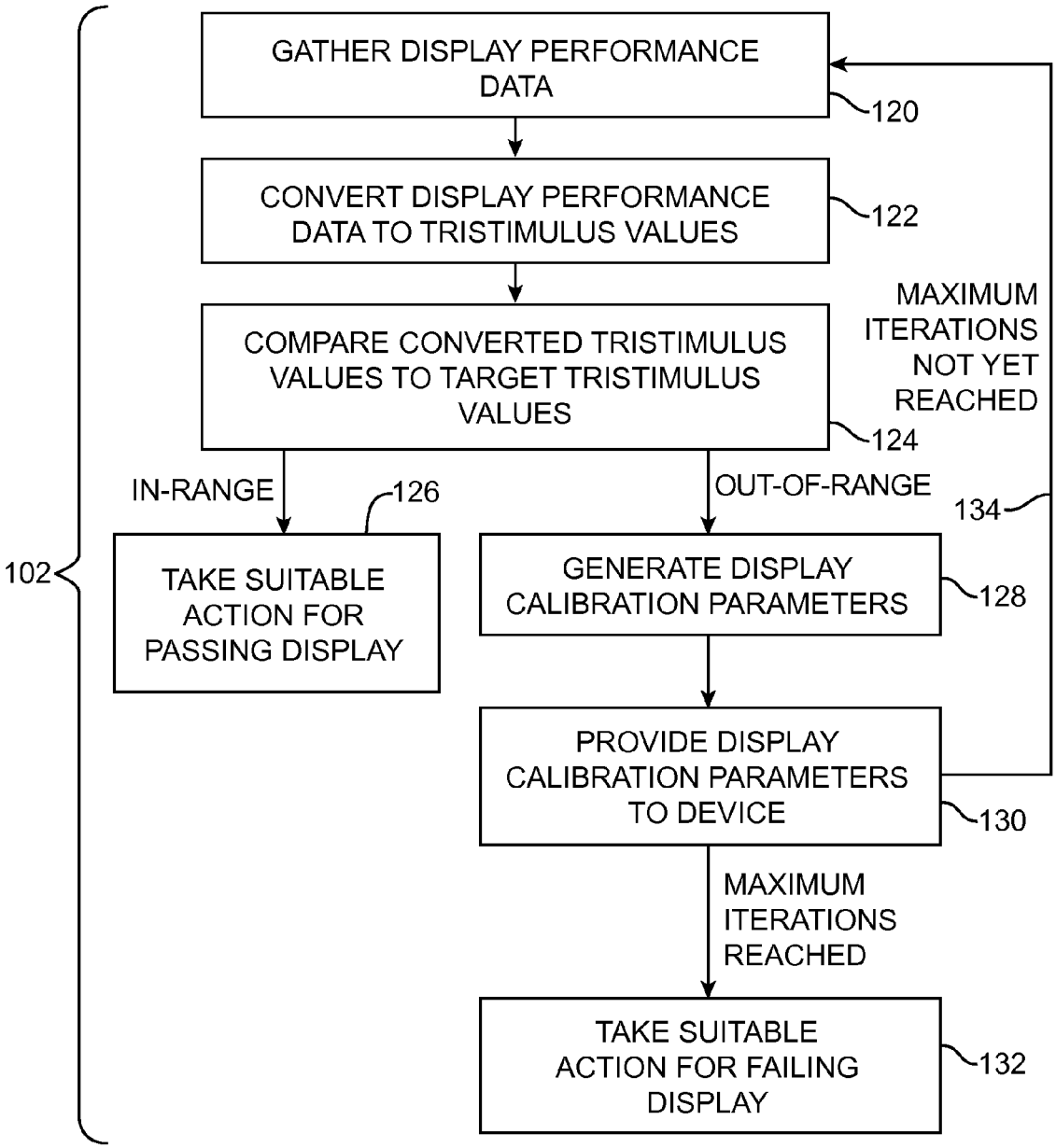
FIG. 8 is a flow chart of illustrative steps involved in performing iterative display white point calibration operations for a display in accordance with an embodiment of the present invention.

A flow chart of illustrative steps involved in performing iterative white point calibration of a display as described above in connection with step 102 of FIG. 6 are shown in FIG. 8.

At step 120, display performance data such as display color performance data may be gathered (e.g., using calibration computing equipment 42 of FIG. 3). Display color performance data may be gathered, for example, by operating the display and gathering display performance data while operating the display. Display 14 may be operated, for example, by computing equipment 42 (e.g., by issuing commands to device 10 to operate display 14) to illuminate some or all pixels of each color a given power level. While operating display 14, color performance data such as a color intensity at each color may be gathered using a light sensor such as light sensor 48 in a test chamber.

At step 122, the gathered display performance data may be processed (e.g., using calibration computing equipment 42). Processing the display performance data may include converting the display performance data (e.g., the color intensity at each color) into a set of display tristimulus values.

At step 124, the converted display tristimulus values may be compared with a set of target tristimulus values (e.g., tristimulus values corresponding to the chromaticity values of target white point TWP of FIG. 4).

Comparing the converted display tristimulus values to the target tristimulus values may include determining whether or not the converted display tristimulus values are within an acceptable range (e.g., range 52 of FIG. 4) of the target tristimulus values.

If it is determined that the converted display tristimulus values are within the acceptable range of the target tristimulus values, calibration system 40 may proceed to step 126.

At step 126, appropriate action may be taken for a passing display. Appropriate action for a passing display may include terminating display calibration operations and shipping device 10 with the passing display to an end-user, passing device 10 with the passing display onto a subsequent calibration station or test station for calibrating or testing other components of device 10, or passing device 10 onto subsequent manufacturing stations for further assembly of device 10.

If it is determined that the converted display tristimulus values are outside of the acceptable range of the target tristimulus values, calibration system 40 may proceed to step 128.

At step 128, calibration system 40 may be used to generate display calibration data such as display calibration parameters for the display based upon measured differences between the converted display tristimulus values and the target tristimulus values.

At step 130, the generated display calibration data (e.g., the display calibration parameters) may be provided to device 10 (e.g., by uploading the display calibration data to the electronic device over path 46).

Uploading the determined display calibration data to device 10 may include storing the calibration data in volatile or non-volatile memory in device 10 for access by software running on circuitry 12 and/or hard coding the determined calibration data into firmware associated with display 14 (e.g., display driver circuitry 20). Stored display calibration data may be used to alter the display color performance of display 14 during subsequent operation of display 14 (e.g., during normal operation of device 10 and/or during subsequent calibration operations).

As indicated by arrow 134, if calibration system 40 has performed less than a predetermined maximum number of iterations of steps 120, 122, 124, 128, and 130, calibration system 40 may return to step 120 and additional display performance data such as display color performance data may be gathered while operating the display using the provided display calibration data. However, this is merely illustrative. If desired, in response to determining that the gathered display performance data is outside of the acceptable range of the target display performance data, calibration system 40 may return to step 110 of FIG. 7 and gather additional gamma performance data for determining a more accurate gamma model for the display. The more accurate gamma model for the display may be used in subsequent display color calibration operations.

If calibration system 40 has performed the predetermined maximum number of iterations of steps 120, 122, 124, 128, and 130, calibration system 40 may proceed to step 132.

At step 132, appropriate action may be taken for a failing display. In situations in which calibration system 40 is unable to successfully calibrate display 14, a display may be considered a failing display. Appropriate action for a failing display may be replacing the display, reworking the display, returning the display to a vendor, or otherwise disposing of a failing display.

Figure 9:
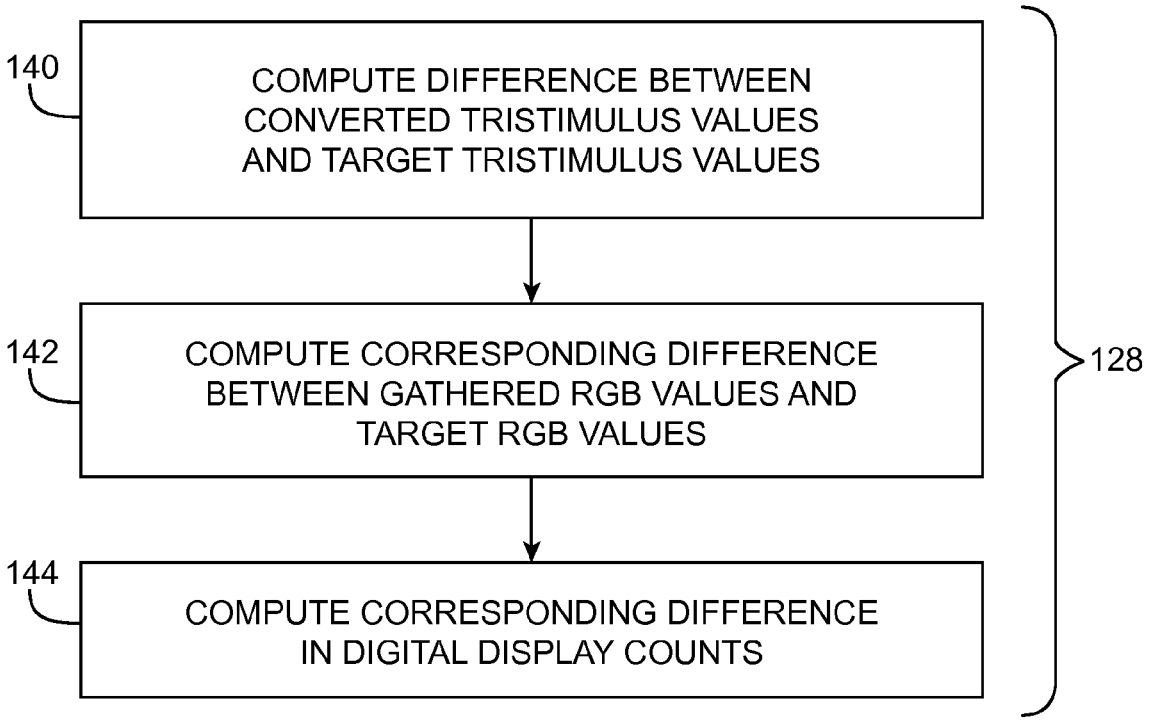
FIG. 9 is a flow chart of illustrative steps involved in generating display calibration parameters using gathered display performance data in accordance with an embodiment of the present invention.

A flow chart of illustrative steps involved in generating display calibration data as described above in connection with step 128 of FIG. 8 are shown in FIG. 9.

At step 140, calibration computing equipment 42 may be used to compute a difference between the converted display tristimulus values and the target tristimulus values.

At step 142, calibration computing equipment 42 may be used to compute a corresponding difference between display color intensities (e.g., red (R), green (G), and blue (B) display intensities) and target color intensities (e.g., target red (R), green (G), and blue (B) display intensities). Computing the corresponding difference between gathered display RGB values and target RGB values may include converting the difference between the converted display tristimulus values and the target tristimulus values to a normalized RGB color space (e.g., by applying a transformation matrix between the tristimulus color space and the RGB color space).

At step 144, the corresponding difference between display color intensities may be converted into a difference in digital display counts (i.e., digital display control values). The corresponding difference between display color intensities may be converted into a difference in digital display counts using the gamma model determined at step 100 of FIG. 6. The converted difference in digital display counts may be used to form display calibration data for correcting the display color performance. The display calibration data may therefore be determined using a gamma model that itself has been determined using a range of digital display control values that is based on white point calibration information.

Figure 10:
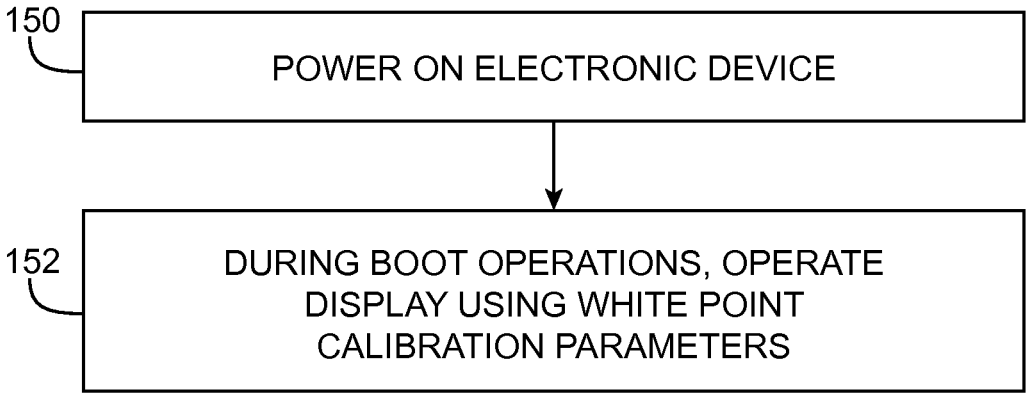
FIG. 10 is a flow chart of illustrative steps involved in operating a display using display calibration parameters provided to the display during manufacturing of the display in accordance with an embodiment of the present invention.

A flow chart of illustrative steps involved in operating a calibrated display in an electronic device is shown in FIG. 10.

At step 150, an electronic device such as device 10 of FIG. 1 having a display may be powered on.

At step 152, during boot operations for the device, the display may be operated using display white point calibration data (e.g., display white point calibration parameters that have been hard coded into firmware associated with display control circuitry for the display) determined during manufacturing of the device. However, this is merely illustrative. If desired, display calibration parameters may be retrieved from volatile or non-volatile memory in the device during boot operations and used to operate the display during normal operation of the device (e.g., after boot operations have been completed).

Figure 11:
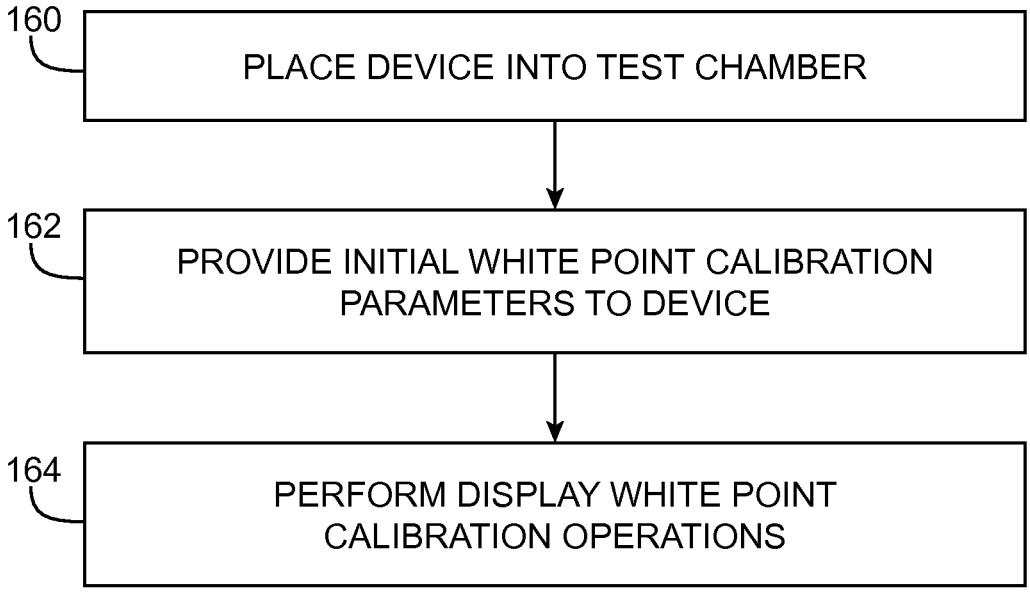
FIG. 11 is a flow chart of illustrative steps involved in performing an initial display calibration for a display based on display color performance of additional previously calibrated displays in accordance with an embodiment of the present invention.

A flow chart of illustrative steps involved in performing calibration of displays in electronic devices using initial white point calibration data (e.g., white point calibration data determined during calibration of other displays in other devices) is shown in FIG. 11.

At step 160, a device such as device 10 may be placed into a test chamber such as test chamber 44 of FIG. 3.

At step 162, initial white point calibration parameters may be provided from calibration computing equipment 42 to device 10. The initial white point calibration parameters may, for example, be a set of average white point calibration data based on an average white point correction of multiple other (previously calibrated) displays. In this way, calibration correction data associated with many calibrated displays may be accumulated and used to reduce the number of iterations used in calibrating a current display under calibration.

At step 164, display white point calibration operations such as those described above in connection with FIG. 6 may be performed.

However, the example of FIG. 11 is merely illustrative. If desired, display calibration operations may be performed without providing any initial white point calibration parameters may be provided to device 10.

The foregoing is merely illustrative of the principles of this invention and various modifications can be made by those skilled in the art without departing from the scope and spirit of the invention.

What is claimed is:

1. A method for obtaining display calibration data and a display gamma value for an electronic device having a display using a calibration system, wherein the display gamma value is a parameter of a gamma model that relates display control settings to display light output levels, the method comprising:

with the calibration system, ascertaining the display gamma value using display white point calibration information, wherein ascertaining the display gamma value comprises ascertaining the display gamma value based on a sub-range of digital display control values to be used in performing display white point calibration operations and wherein the sub-range of digital display control values corresponds to a sub-range of digital display control values within a larger range of available digital display control values; and with the calibration system, performing the display white point calibration operations using the ascertained display gamma value.

2. The method defined in claim 1 wherein ascertaining the gamma value using the display white point calibration information comprises:

obtaining the sub-range of digital display control values to be used in performing the display white point calibration operations; and gathering display intensity performance data using a set of digital display control values that are within the obtained sub-range of digital display control values to be used in performing the display white point calibration operations.

3. The method defined in claim 2 wherein ascertaining the display gamma value using the display white point calibration information further comprises:

ascertaining the display gamma value using the gathered display intensity performance data.

4. The method defined in claim 3 wherein ascertaining the display gamma value using the display intensity performance data comprises:

identifying an optimal gamma parameter for the gamma model that results in a match between the gamma model and the gathered display intensity performance data in the obtained sub-range.

5. The method defined in claim 4 wherein identifying the optimal gamma parameter for the gamma model comprises identifying the optimal gamma parameter for a gain-offset-gamma model.

6. The method defined in claim 4 wherein identifying the optimal gamma parameter for the gamma model comprises identifying the optimal gamma parameter for a gain-offset-gamma-offset model.

7. The method defined in claim 4 wherein identifying the optimal gamma parameter for the gamma model comprises identifying the optimal gamma parameter for a gain-gamma-offset model.

8. The method defined in claim 2 wherein gathering the display intensity performance data using the set of digital display control values that are within the obtained sub-range of digital display control values to be used in performing the display white point calibration operations comprises:

operating the display using the set of digital display control values that are within the sub-range of digital display control values; and gathering display intensity performance data while operating the display using the set of digital display control values.

9. The method defined in claim 8 wherein performing the display white point calibration operations using the ascertained gamma value comprises:

gathering display color performance data while operating the display using an additional set of digital display control values that are within the sub-range of digital display control values.

10. The method defined in claim 9, further comprising:

determining whether the gathered display color performance data is within a predetermined range of target color performance data.

11. The method defined in claim 10, further comprising:

in response to determining that the gathered display color performance data is within the predetermined range of the target color performance data, terminating display calibration operations.

12. The method defined in claim 10, further comprising:

in response to determining that the gathered display color performance data is outside the predetermined range of the target color performance data, generating the display calibration data using the gathered display color performance data and the ascertained display gamma value; and providing the display calibration data to the electronic device.

13. The method defined in claim 1, further comprising:

prior to performing the display white point calibration operations using the ascertained display gamma value, providing initial display calibration data to the electronic device, wherein performing the display white point calibration operations using the ascertained display gamma value comprises:

operating the display using the initial display calibration data, and gathering display color performance data while operating the display using the initial display calibration data.

14. An electronic device, comprising:

a display having display control circuitry configured to generate display signals for the display and configured to store display color performance calibration data, wherein the display color performance calibration data is based on information gathered while operating the display using a sub-range of digital display control values and wherein the sub-range of digital display control values corresponds to a sub-range of digital display control values within a larger range of available digital display control values; and storage and processing circuitry configured to perform startup operations for the device and configured to provide display data to the display.

15. The electronic device defined in claim 14, wherein the storage and processing circuitry is configured to provide startup information to the display while performing the startup operations for the device.

16. The electronic device defined in claim 15 wherein the display is configured to display the startup information on the display using the display color performance calibration data that is stored in the display control circuitry.

17. The electronic device defined in claim 16 wherein the display comprises a liquid crystal display.

18. A method of operating an electronic device, having a display with display control circuitry, the method comprising:

powering on the electronic device;

performing boot operations for the electronic device; and while performing boot operations for the electronic device, operating the display in a color calibrated mode using display white point calibration data that is stored in the display control circuitry, wherein the display white point calibration data is based on information gathered while operating the display using a sub-range of digital display control values and wherein the sub-range of digital display control values corresponds to a sub-range of digital display control values within a larger range of available digital display control values.

19. The method defined in claim 18 wherein operating the display in the color calibrated mode using the display white point calibration data that is stored in the display control circuitry comprises:

providing display control signals from additional circuitry in the electronic device to the display.

20. The method defined in claim 19 wherein operating the display in the color calibrated mode using the display white point calibration data that is stored in the display control circuitry further comprises:

adjusting the provided display control signals using the display white point calibration data that is stored in the display control circuitry.

21. The method defined in claim 20 wherein operating the display in the color calibrated mode using the display white point calibration data that is stored in the display control circuitry further comprises:

operating display pixels in the display using the adjusted display control signals.

* * * * *